United States Patent [19]

Glemming et al.

[11] Patent Number: 4,622,880

[45] Date of Patent: Nov. 18, 1986

[54] CHORDING APPARATUS FOR STRINGED MUSICAL INSTRUMENT

[75] Inventors: Marvin R. Glemming, 4900 Yorktown La., Plymouth, Minn. 55442; Walter I. Bieger, St. Paul, Minn.

[73] Assignee: Marvin R. Glemmings, Plymouth, Minn.

[21] Appl. No.: 652,872

[22] Filed: Sep. 20, 1984

[51] Int. Cl.[4] ..... G10D 3/08

[52] U.S. Cl. ..... 84/317

[58] Field of Search ..... 84/315–317

[56] References Cited

U.S. PATENT DOCUMENTS

| | | | |
|---|---|---|---|
| 295,984 | 4/1884 | Cooke | 84/315 |
| 314,540 | 3/1885 | Oleson | 84/315 |
| 545,963 | 9/1895 | Ling | 84/317 |
| 589,658 | 9/1897 | Kelman | 84/317 |
| 831,238 | 9/1906 | Panelli | 84/317 |
| 1,094,819 | 4/1914 | Sandell | 84/315 X |
| 1,120,091 | 12/1914 | Schmidt | 84/317 |
| 1,437,026 | 11/1922 | Spartivento | 84/317 |
| 1,785,311 | 12/1930 | Johnson | 84/317 |
| 2,132,281 | 10/1938 | Adamson | 84/317 |
| 2,442,181 | 5/1948 | Sloan | 84/317 |
| 2,450,210 | 9/1948 | Sprague | 84/317 X |
| 2,669,151 | 2/1954 | Maccaferri | 84/317 |
| 2,790,344 | 4/1957 | Brimhall | 84/317 |
| 2,798,398 | 7/1957 | Hayes | 84/317 |
| 3,154,994 | 11/1964 | Blohm | 84/317 |
| 3,422,717 | 1/1969 | Roussel | 84/317 |
| 3,439,571 | 4/1969 | Ryan | 84/312 R |
| 3,446,108 | 5/1969 | Mitchell, Jr. | 84/317 |
| 3,568,560 | 3/1971 | Chang | 84/317 |
| 3,776,088 | 12/1973 | Jones | 84/317 |
| 3,915,051 | 10/1975 | Kincaid | 84/317 |

FOREIGN PATENT DOCUMENTS

| | | | |
|---|---|---|---|
| 261615 | 11/1926 | United Kingdom | 84/317 |

*Primary Examiner*—Lawrence R. Franklin

[57] ABSTRACT

A chording apparatus for stringed musical instruments is provided that automatically forms complex chording arrangements on the instrument keyboard in response to the simple depression of a single button. The chording apparatus hereof includes a unique arrangement of selection buttons, actuating arms, and string depressing hammers, to allow for the selection of a maximum number of chords with a minimum number of apparatus parts. The chording apparatus also includes a unique, one piece biasing plate that urges each of the string depressing hammers to their string clearing positions. The apparatus can be quickly attached or detached from the neck of a string instrument, is adaptable to keyboards of various widths, and is particularly designed for ease of assembly.

8 Claims, 16 Drawing Figures

CHORDING APPARATUS FOR STRINGED MUSICAL INSTRUMENT

TECHNICAL FIELD

This invention relates to an apparatus for forming chords on a stringed musical instrument.

BACKGROUND ART

Stringed instruments typically include a plurality of strings grouped together along a fingered keyboard. For instance, a guitar includes six strings stretched across an elongated keyboard neck. The strings are depressed at various points on the keyboard to form different musical notes. Musical chords may be formed by depressing individual strings at different points along the keyboard.

The forming of chords on stringed musical instruments takes a certain degree of manual dexterity and skill. Playing instruments such as the guitar is therefore difficult at best for the novice, and presents the handicapped with sometimes insurmountable challenges.

Various attempts have been made to provide automatic chord forming apparatus that can be attached to the neck of a guitar or other stringed instrument. The goal of such apparatus is to simplify the procedure for forming musical chords by simultaneously depressing several strings of the guitar in response to depression of a single actuating key. Several previous attempts to provide a guitar chording apparatus include U.S. Pat. Nos. 3,446,108, 1,120,091, 831,238, and 589,658.

An effective guitar chording apparatus must be able to simultaneously and positively depress a preselected group of strings, enabling the guitar to produce consistent, clear, and melodious chords. The apparatus must be able to be quickly and easily attached or detached from the neck of an instrument, and most preferably should be adaptable to keyboards of various widths. An effective guitar chording apparatus needs to be compact, designed with a minimum of parts, capable of forming a large number of different chords, and easy to manufacture. None of the guitar chording apparatus previously developed have been able to combine each of the above enumerated necessary attributes into a single device.

SUMMARY OF THE INVENTION

The problems outlined above are in large measure solved by the chording apparatus for stringed instruments in accordance with the present invention. That is to say, the apparatus hereof is comprised of a minimum number of parts, thereby facilitating manufacture and reducing costs, provides for the consistent, positive displacement of selected strings to form melodious chords, is easily attached to the neck of a guitar or other stringed instrument, can accommodate, in a single model, keyboard widths of differing sizes, and allows for the selection of a large number of chords in a single device.

The external appearance of the chording apparatus in accordance with the present invention broadly includes a case mountable upon the keyboard, or neck, of a guitar or similar stringed instrument, a plurality of chord selecting buttons on the case top wall, and a pair of straps for securing the case to the neck of the instrument. Internally, the chording apparatus hereof broadly includes a plurality of string depressing hammers pivotally mounted on a support plate and shiftable in an arcuate path of travel between string clearing and string depressing positions, a plurality of actuating arms responsive to depression of the chord selecting buttons to select predetermined combinations of the string depressing hammers, and a lowermost biasing plate that forms the case bottom wall, and which includes a plurality of resilient biasing arms integrally molded as part of the plate for urging the string depressing elements to their string clearing positions. The unique arrangement of buttons, actuating arms, and hammers provides for the selection of a maximum number of chord combinations with a minimum number of parts. The simplicity and effectiveness of the biasing plate with integrally molded biasing arms greatly reduces manufacturing time and costs.

DETAILED DESCRIPTION OF THE DRAWINGS

Figure 1:
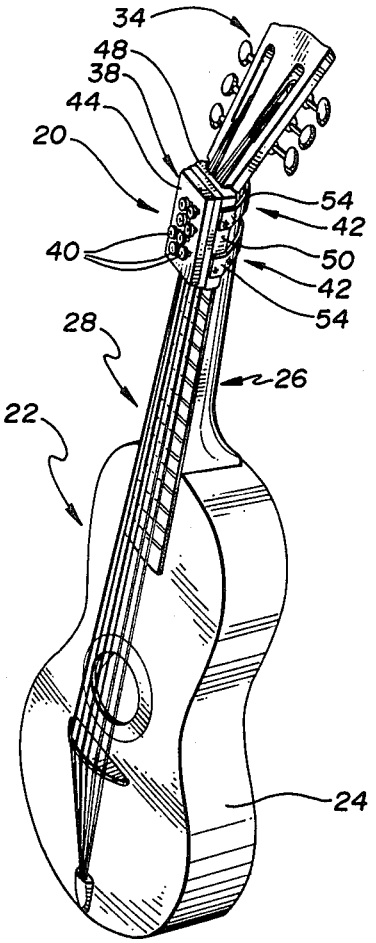
FIG. 1 is a perspective view of a guitar with a chording apparatus in accordance with the present invention attached to the guitar's neck.

Referring to the drawings, the chording apparatus 20 in accordance with the present invention is depicted in FIG. 1 attached to a guitar 22. The guitar 22 includes resonant chamber 24, neck 26, and strings 28. The neck 26 includes an upper keyboard surface 30 that includes frets 32. The neck also includes tuning assembly 34 separated from the keyboard 30 by nut 36.

Figure 2:
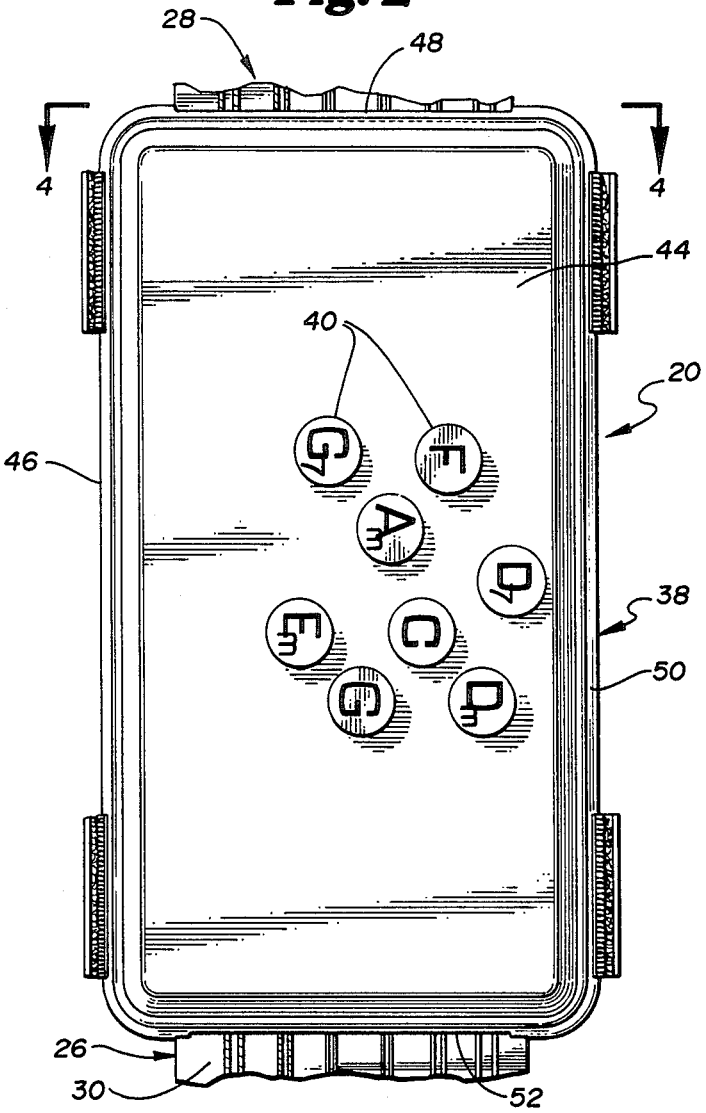
FIG. 2 is a top view of the chording apparatus mounted on the guitar neck.
Figure 3:
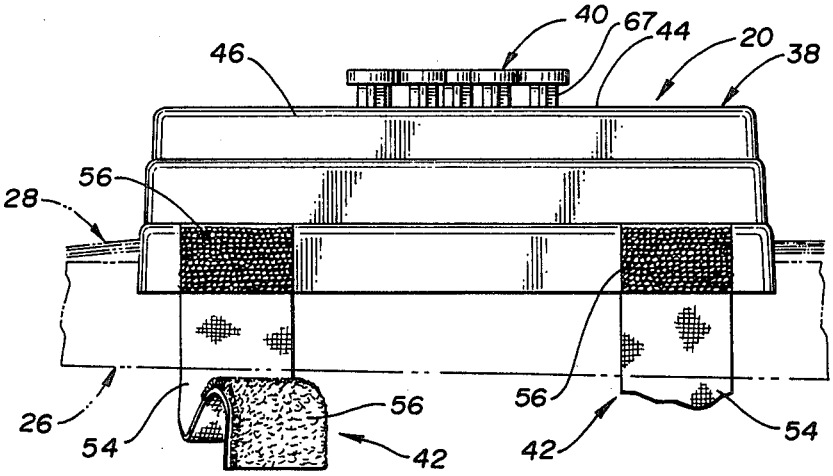
FIG. 3 is a side elevational view of the chording apparatus mounted on the guitar neck.

The chording apparatus 20, in its external appearance, broadly includes case 38, finger engageable chord selection buttons 40, and a pair of attachment assemblies 42. The case 38 includes top wall 44 and side walls 46, 48, 50, 52, preferably all integrally molded from a suitable synthetic resin. The chord selection buttons 40 project upwardly from top wall 44. The musical chord selected by each button is enscribed on each button 40, as depicted in FIG. 2. Attachment assemblies 42 comprise nylon straps 54 that are permanently affixed to case side wall 46, and detachably attached to case side wall 50 by a fabric 56 that can be fastened to itself, such as the material sold under the name Velcro. The straps 54 extend around neck 26 of guitar 22, thereby fixedly positioning the chording apparatus 20 on the guitar neck 26.

Internally, the chording apparatus 20 broadly includes a set of eight actuating arms 58*a*–58*h* (each actuating arm being associated with a respective button 40), an intermediate support plate 60, three separate sets of nested string depressing hammers 62*a*, 62*b*, 62*c*, and biasing plate 64.

Figure 9:
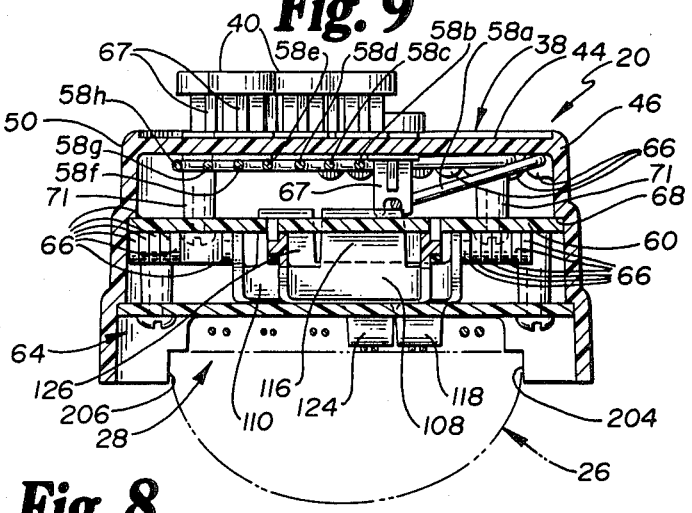
FIG. 9 is a sectional view taken along line 9—9 of FIG. 8.
Figure 11:
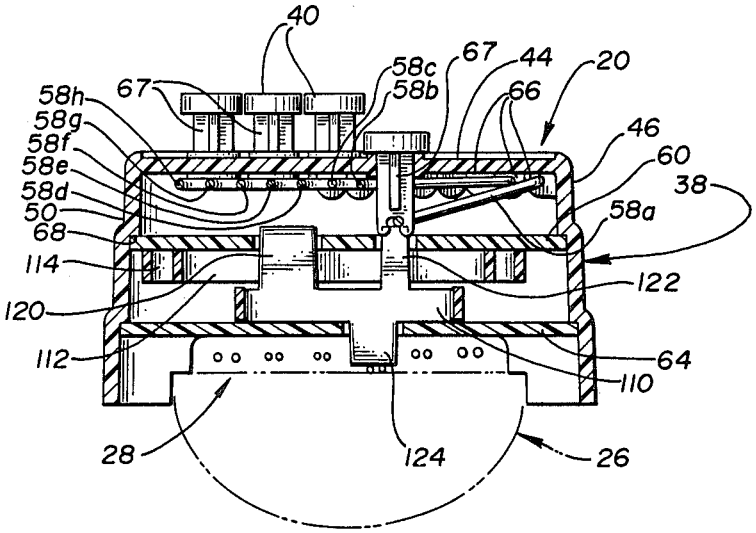
FIG. 11 is a sectional view taken along line 11—11 of FIG. 10 and with the removed parts replaced.

Actuating arms 58*a–h* are generally U-shaped, and pivotally coupled at each end to the inner face of the case top wall 44 via respective pivot lugs 66. As best depicted in FIGS. 9 and 11, each actuating arm is snappably engaged by the stem 67 of an individual chord selecting button 40. The stems 67 are +-shaped in cross section for strength, and are received through +-shaped apertures in the case top wall 44, to prevent rotation of the buttons 40. The actuating arms are preferably formed from oil tempered steel.

Intermediate support plate 60 is received within case 38. The plate 60 is positioned within the case 38 by internal, peripheral ledge 68, and is maintained in positioned by screws 70 positioned at each corner of the support plate. The screws are received within support posts 71. The intermediate plate may also be held in position by heat staked posts, rather than by use of screws. Intermediate support plate 60 includes downward facing hammer receiving pivot lugs 72 integrally molded with the support plate 60, and a plurality of irregularly shaped hammer clearing apertures 74, 76, 78, 80, and 82. Four biasing plate support posts 84,86, 88, 90 project downwardly from the intermediate support plate 60.

The three nested sets of string depression hammers 62*a–c* are positioned so as to be oriented between four successive frets. In particular, hammer set 62*a* is positioned between the nut and the first fret (when the chording apparatus 20 is positioned at the end of the guitar neck 26), set 62*b* is positioned between the first and second fret, and set 62*c* is located between the second and third fret. As best seen in FIG. 11, each string depressing hammer includes a U-shaped frame, upwardly extending, actuating arm engaging projections, a downwardly extending, string contacting projection, and pivot posts. The U-shaped frames are advantageously formed from a synthetic resin and may include strength ribs (not shown) along their surfaces for rigidity.

Figure 5:
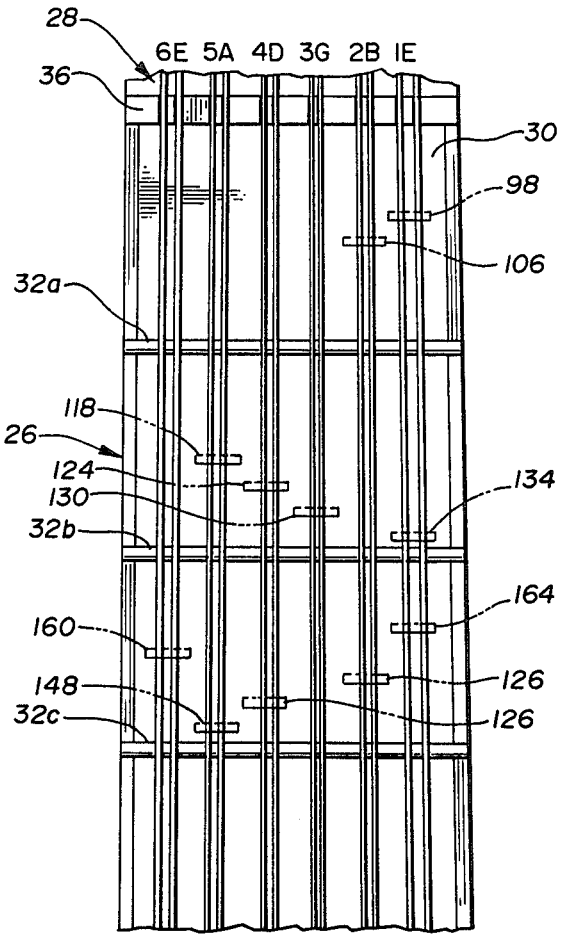
FIG. 5 is a diagram of the guitar string layout at the cross end of the neck showing the guitar nut, frets, and impact points for the string depressing hammers.
Figure 7:
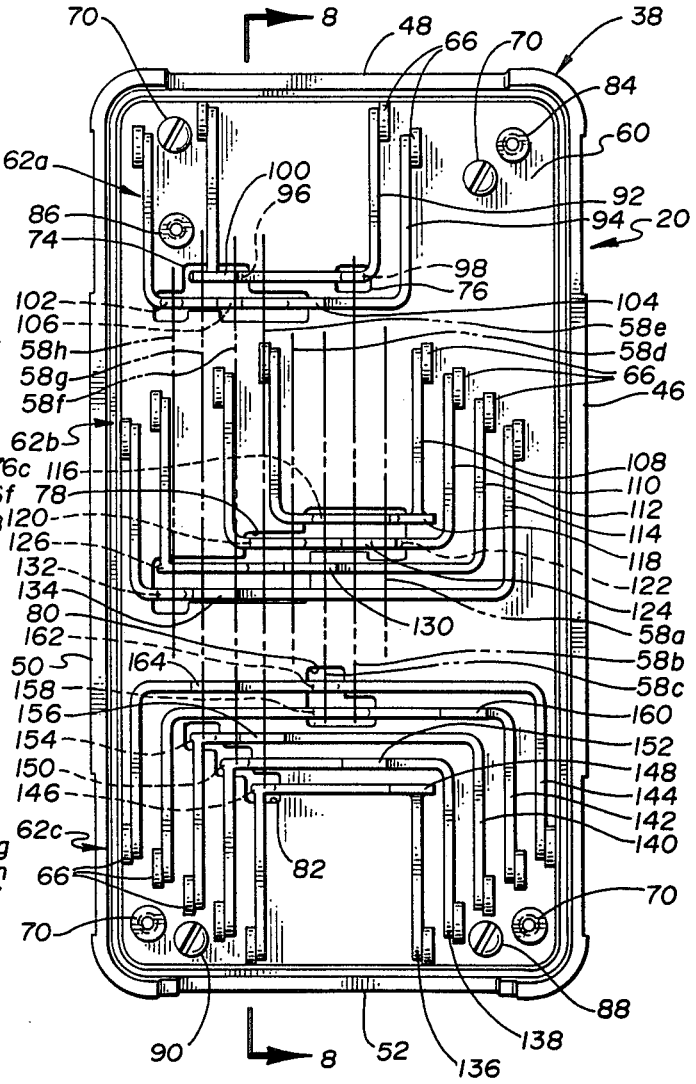
FIG. 7 is a bottom plan view of the chording apparatus with the biasing plate removed, fragmentary phantom lines depicting the actuating arms and contact points between the actuating arms and hammers.
Figure 10:
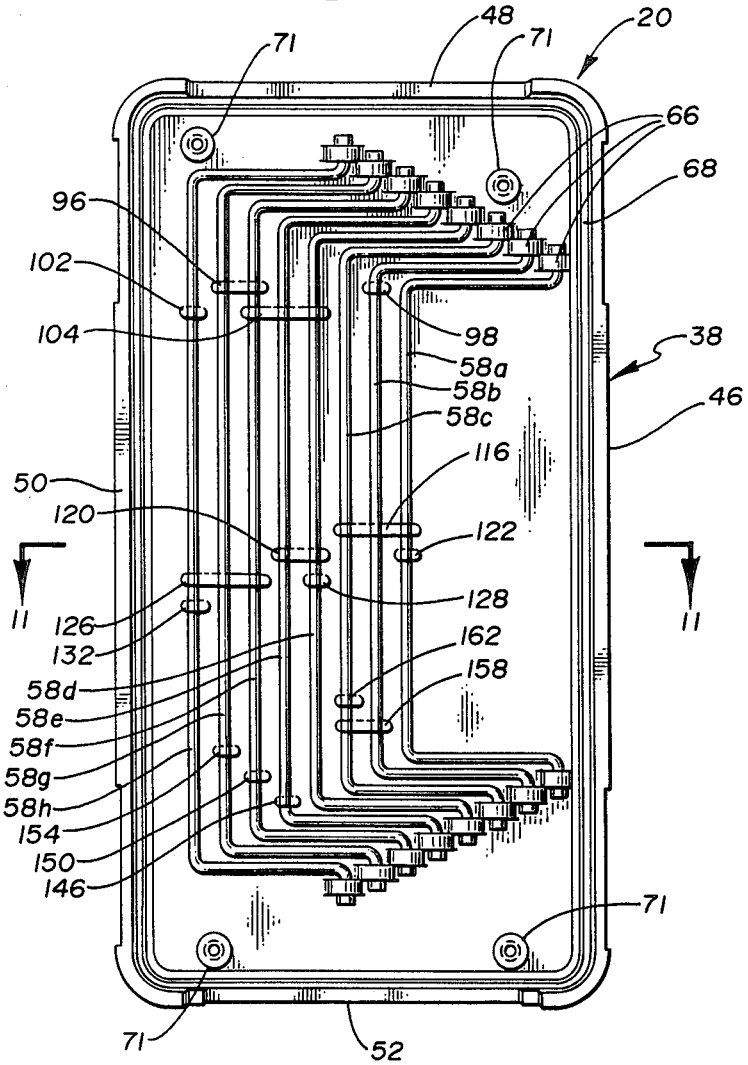
FIG. 10 is a bottom plan view of the chording apparatus with the biasing plate, string depression hammers, and intermediate support plate removed.

The structure of each individual string depressing hammer will now be described, with references to FIGS. 5, 7 and 10. FIG. 5 depicts the striking point of the respective string contacting projection of each hammer, and FIG. 10 shows the point of contact between various actuating arms 58*a*–58*h* relative to the upwardly extending arm actuating engaging projections of the hammers. Note that FIG. 7 indicates the alignment of the various actuating arms (in phantom lines) with the upwardly extending, actuating arm engaging hammer projections (also in phantom lines).

String depressing hammer set 62*a* includes hammers 92, 94. Hammer 92 includes actuating arm engaging projections 96, 98. Projection 96 is aligned to engage actuating arms 58*f*, 58*g*, and projection 98 is oriented to be engaged by actuating arm 58*b*. Hammer 92 includes string contacting projection 100 positioned to engaged the high E string of the guitar. Hammer 94 includes upwardly extending, actuating arm engaging projections 102, 104. Projection 102 is oriented for engagement by actuating arm 58*a*, and projection 104 is oriented to be engageable by actuating arms 58*d*, 58*e*, 58*f*. Hammer 94 includes downward extending, string contacting projection 106, positioned to depress the B string.

String depressing hammer set 62*b* includes hammers 108, 110, 112, 114. Hammer 108 includes upwardly extending projection 116 engageable by actuating arms 58*a*, 58*b*, 58*c*, and downwardly extending projection 118 engageable with the A string. Hammer 110 includes upwardly extending projection 120 engageable by actuating arms 58*d*, 58*e*, upwardly extending projection 122 engageable by actuating arm 58*a*, and downward projection 124, engageable with the B string. Hammer 112 includes upwardly extending projection 126 engageable by actuating arms 58*f*, 58*g*, 58*h*, upwardly extending projection 128 engageable by actuating arm 58*d*, and downwardly extending projection 130 engageable with the G string. Hammer 114 includes upwardly extending projection 132 engageable by actuating arm 58*h*, and downwardly extending projection 134 engageable with the high E string.

String depression hammer set 62*c* includes hammers 136, 138, 140, 142, 144. Hammer 136 includes upwardly extending projection 146 engageable with actuating arm 58*e*, and downwardly extending projection 148 engageable with the A string. Hammer 138 includes upwardly extending projection 150 engageable with actuating arm 58*f* and downwardly extending projection 152 engageable with the D string. Hammer 140 includes upwardly extending projection 154 engageable with actuating arm 58*g*, and downwardly extending projection 156 engageable with the B string. Hammer 142 includes upwardly extending projection 158 engageable with actuating arms 58*b*, 58*c*, and downwardly extending projection 160 engageable with the low E string. Hammer 144 includes upwardly extending projection 162 engageable with actuating arm 58*c*, and outwardly extending projection 164 engageable with the high E string.

Figure 13:
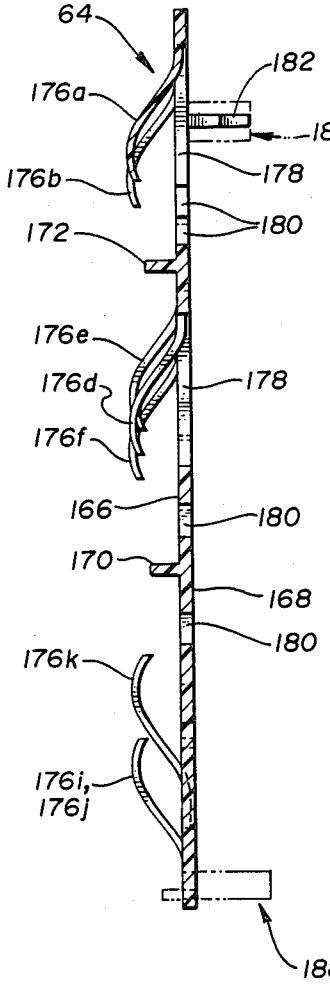
FIG. 13 is a sectional view taken along line 13—13 of FIG. 12.
Figure 12:
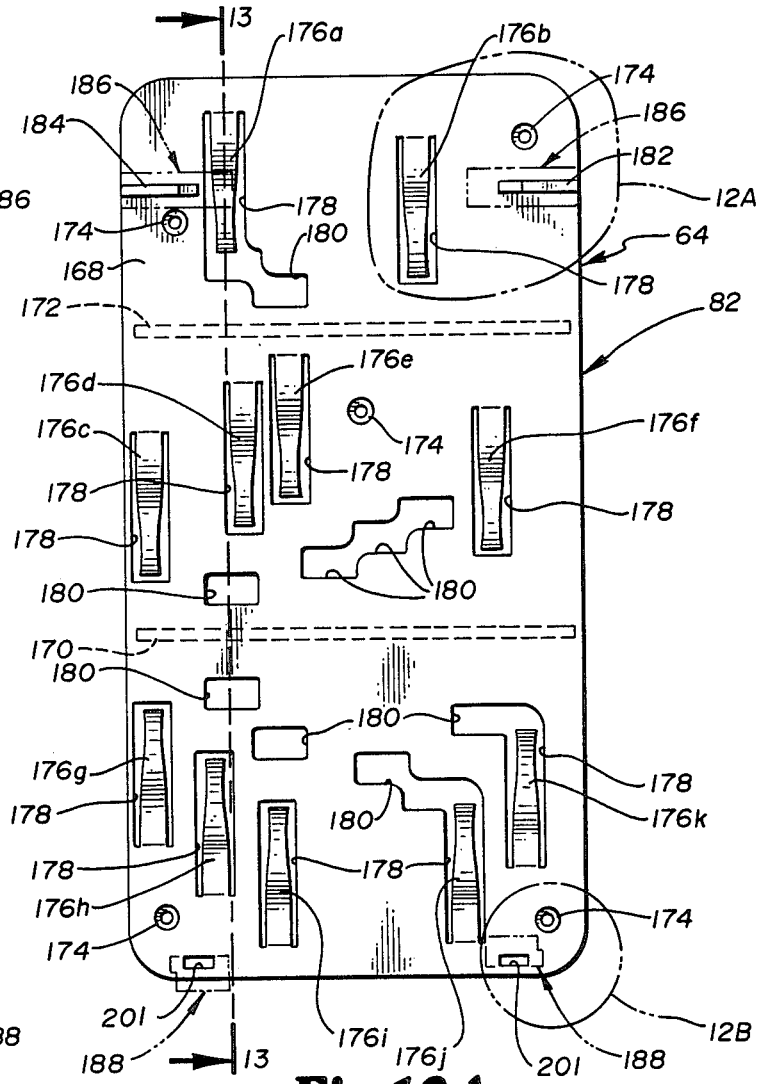
FIG. 12 is a bottom plan view of the biasing plate.
Figure 14:
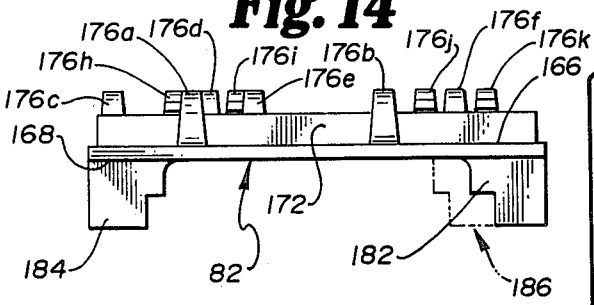
FIG. 14 is a side elevation view of the biasing plate.

The biasing plate 64 is best depicted in FIGS. 12–14. The biasing plate 64 includes upper and lower surfaces 166, 168, respectively. The upper surface 166 includes strength ribs 170, 172. The plate 64 includes screw receiving apertures 174 aligned with respective screw receiving posts 84, 86, 88, 90 on intermediate support plate 60.

The biasing plate 64 includes individual biasing elements 176*a–k* that are integrally molded with the plate, biasing element clearing apertures 178, and hammer clearing apertures 180. As best seen in FIG. 19, several of the above described apertures merge to form larger, irregularly shaped apertures. The biasing elements 176 are S-shaped, and, as best seen in FIG. 12, gradually narrow in width from their base to their tip. Opposed nut aligning brackets 182, 184 extend downwardly from the lower biasing plate surface 168.

Figure 12A:
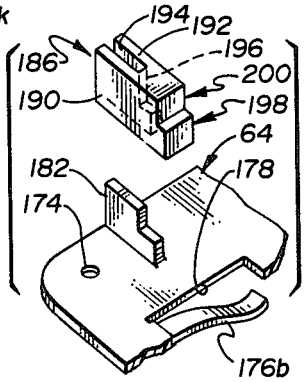
FIG. 12*a* is a fragmentary, perspective view taken at 12A of FIG. 12.
Figure 12B:
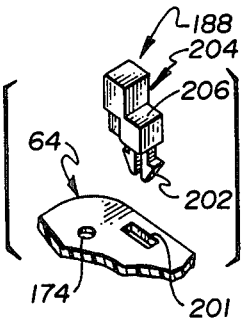
FIG. 12*b* is a fragmentary, perspective view taken at 12B of FIG. 12.

Referring to FIGS. 12*a* and 12*b*, inserts 186, 188 may be received by biasing plate 64. Although only one insert is shown in each of FIG. 12*a* and FIG. 12*b*, it will be understood that inserts are arranged in opposed pairs at either end of the biasing plate 64.

Referring to FIG. 12*a*, the adjustment inserts 186 are received by nut aligning brackets 182, 184. In particular, the sidewalls 190, 192 of insert 186 define slot 194 within which brackets 182, 184 may be received in frictional engagement. As depicted in phantom lines, slot 194 includes a stepped inner wall 196 that conforms to the step defined by each bracket 182, 184. The front wall 198 of adjustment inserts 186 defines neck receiving step 200.

Referring to FIG. 12*b*, neck adjustment inserts 188 are receivable within slots 201 of biasing plate 64. In particular, bifurcated prongs 202 of insert 188 may be inserted into slots 201 in a locked fit. The front was 204 of each insert 188 includes neck receiving step 206.

Figure 4:
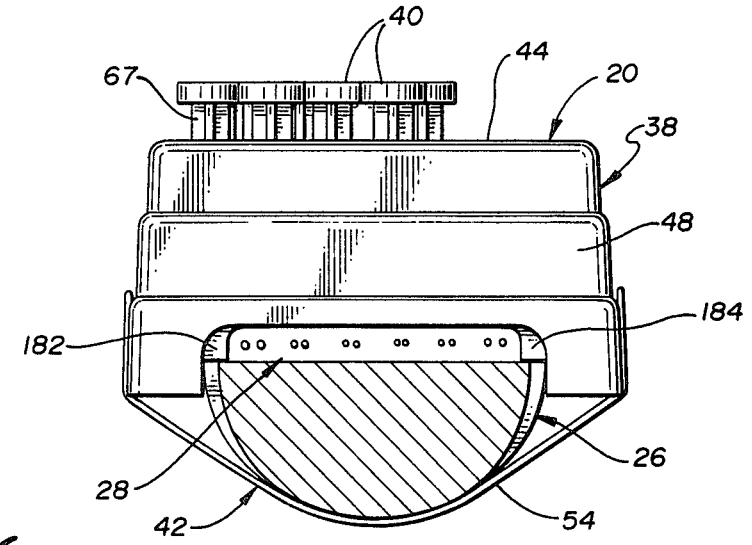
FIG. 4 is a sectional view taken along line 4—4 of FIG. 2.
Figure 6:
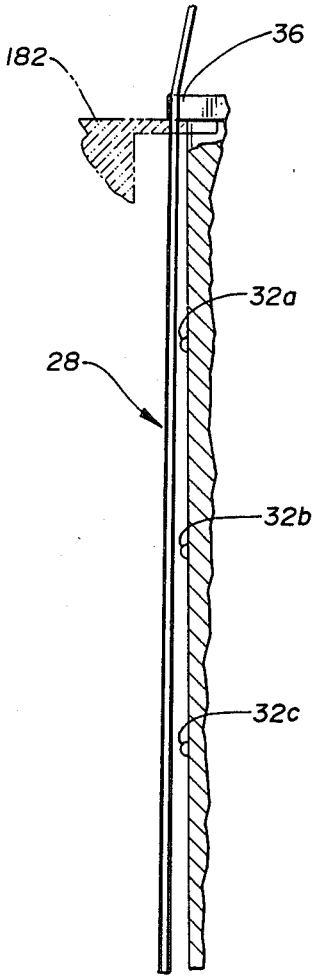
FIG. 6 is a fragmentary side view of the guitar neck, and chording apparatus positioning bracket.

The chording apparatus 20 in accordance with the present invention may be adapted for use on guitars having various neck widths by the use of inserts 188. Referring to FIG. 4, it will be seen that the guitar neck 26 is received by brackets 182, 184, thereby positioning the chording apparatus 20 in proper alignment with the strings 28. As shown in FIG. 6, the brackets 182, 184 abut against the nut 36 to align the chording apparatus 20 with the frets 32. It will be apparent that a guitar of narrower width than that depicted in FIG. 4 would not be received by brackets 182, 184 in a snug fit, and the chording apparatus 20 would not be properly and securely positioned over the strings 28. The use of width adjustment inserts 186, however, effectively narrows the distance between each opposed pair of aligning brackets 182, 184. Similarly, and referring to FIG. 9, it will be seen that steps 204, 206 are defined by the case 38, and that the neck 26 is received within steps in an aligning fit. The use of inserts 188 enables the chording apparatus 20 to receive, in an aligning fit, the neck of a guitar that is too narrow to be received within the gap defined by steps 204, 206.

In operation, musical chords can be formed on a stringed instrument with the present invention by merely depressing one of the chord selecting buttons 40. Pressing a button 40 shifts one of the eight actuating arms 58*a–h* downwardly and into contact with the upwardly extending projections of selected ones of the string depressing hammers. The subsequent downward shifting of the string depression hammers stops selected strings behind selected frets 32 on the guitar keyboard.

Figure 8:
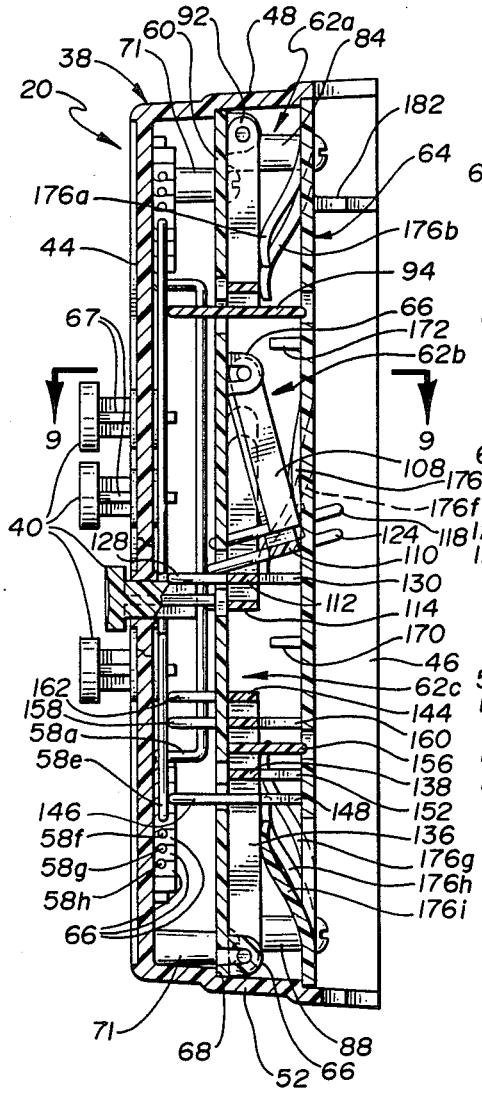
FIG. 8 is a sectional view taken along line 8—8 of FIG. 7.

In particular, and referring to FIGS. 8, 9 and 11, the button 40 for selecting the E minor chord is shown in the depressed position. The downward shifting of the E minor button 40 in turn shifts actuating arm 58*a* in a downward, arcuate path of travel, and into shifting engagement with upwardly extending projections 122 and 116 of string depressing hammers 110 and 108, respectively. As shown in FIG. 9, the downward shifting of string depressing hammers 110 and 108 stops the A and D string behind the second fret 32*b*. In particular downwardly extending projections 124 and 118 of hammers 110 and 108, respectively, contact the A and D strings.

Upon release of the E minor button 40, the biasing elements 176*e*, 176*d* depressed when the hammers 108, 110 are shifted downwardly through their arcuate paths of travel, urge the hammers 108, 110 back to their string clearing positions. The upward shifting of the hammers 108, 110 in turn forces the actuating arms 58*a* and attached E minor chord button 40 upwardly into their normal, undepressed positions.

I claim:

1. A chording apparatus for a musical instrument having a plurality of strings extending along a keyboard, comprising means for manually selecting a chord to be played;

a plurality of individual string depressing means shiftable between string clearing and string depressing positions, each of said individual depressing means being operably engageable with predetermined ones of said strings when in said string depressing position;

actuating means responsive to said chord selecting means for shifting predetermined ones of said depressing means to said string depressing positions, at least some of said string depressing means being shiftable by more than one of said actuating means whereby said individual depressing means can be used in multiple chord combinations; and a biasing plate having a plurality of resilient biasing elements integrally molded as part of said plate, each biasing element being operably coupled with a respective one of said string depressing means for urging said respective string depressing means to said string clearing position.

2. The apparatus as claimed in claim 1, said string depressing means comprising pivotally mounted frames, said frame including at least one projection engageable with preselected ones of said actuating means, and an opposed projection engageable with a selected one of said strings.

3. The apparatus as claimed in claim 1, said string depressing means being arranged in spaced apart nested sets, whereby the string depressing means of each nested set engage said strings at different points along the length of said keyboard.

4. The apparatus as claimed in claim 1, said actuating means comprising a plurality of nested, pivotally mounted, U-shaped actuating arms, each of said arms operably coupled with a single one of said chord selecting means.

5. The apparatus as claimed in claim 1, said biasing elements including a base portion integrally molded with said plate and a tip portion spaced apart from said base portion, said biasing elements gradually narrowing in width from said base portion to said tip portion.

6. The apparatus as claimed in claim 5, said biasing elements being S-shaped.

7. The apparatus as claimed in claim 1, said apparatus including positioning means for receiving said keyboard in an aligning fit, said positioning means being selectively adjustable to receive keyboards of various widths.

8. The apparatus as claimed in claim 7, said positioning means including spaced apart, stepped brackets defining a keyboard receiving gap for receiving said keyboard and selectively detachable inserts for adjusting the width of said gap.

* * * * *